United States Patent [19]

Zulkowitz

[11] Patent Number: 4,623,324

[45] Date of Patent: Nov. 18, 1986

[54] METHOD AND APPARATUS FOR MAKING FUEL ELEMENTS FROM NEWSPAPER SHEETS OR THE LIKE

[75] Inventor: Albert J. Zulkowitz, Woodmere, N.Y.

[73] Assignee: A. Zulkowitz Associates, Woodmere, N.Y.

[21] Appl. No.: 665,160

[22] Filed: Oct. 26, 1984

[51] Int. Cl.[4] ..... B31F 7/00

[52] U.S. Cl. ..... 493/462; 44/38; 493/303

[58] Field of Search ..... 44/2, 14, 38, 40; 493/394, 303, 307, 462, 393; 126/224, 283; 211/71, 44, 45, 49.1; 144/192

[56] References Cited

U.S. PATENT DOCUMENTS

| | | | |
|---|---|---|---|
| 1,025,902 | 5/1912 | Dolan | 44/40 |
| 1,191,458 | 7/1916 | Phillips | 44/40 |
| 3,838,679 | 10/1974 | Welch | 211/49.1 |
| 3,958,499 | 5/1976 | Albee, Jr. | 493/307 |
| 4,068,564 | 1/1978 | Dahlstrom | 493/462 |
| 4,116,645 | 9/1978 | Dalzell | 44/38 |

*Primary Examiner*—Francis S. Husar
*Assistant Examiner*—Robert Showalter
*Attorney, Agent, or Firm*—Darby & Darby

[57] ABSTRACT

Newspaper or the like is prepared for burning by folding and rolling operations to provide its complete combustion. The paper is folded such that one edge is placed parallel to and spaced from the opposite edge. The folded paper is then rolled to form a cylindrical fuel element. The cylindrical fuel element is advantageously placed in a fixture retaining its rolled and folded condition during binding. The fixture includes a first and second end supports forming a rectangular channel receiving the cylindrical fuel element. A connecting member maintains the supports relative to each other. A constricting member is positioned in the channel which reduces the width of the channel to maintain the fuel element in its rolled condition. The fuel elements may be in the form of kindling sticks, or bundles of such sticks, or individual logs.

11 Claims, 9 Drawing Figures

METHOD AND APPARATUS FOR MAKING FUEL ELEMENTS FROM NEWSPAPER SHEETS OR THE LIKE

BACKGROUND OF THE INVENTION

The present invention relates to a method and apparatus which will produce combustible fuel elements from discarded newspapers or the like, and relates also to the improved product thus produced.

It has long been recognized that discarded newspapers and the like newsprint or papers form a potential fuel material. Particularly at present, policies of conservation and economy dictate that such discarded materials be utilized, to avoid unnecessary depletion of material resources, such as wood from which such materials are made. Thus, use of discarded newspapers would reduce demands for other fuels, such as oil, gas or coal, and thus further conserve natural resources.

Numerous attempts to utilize newspapers in a configuration for efficient burning have been made. Examples are represented in U.S. Pat. Nos. 1,025,902, 1,191,458 and 3,958,499. Thus, U.S. Pat. No. 1,025,902 to E. J. Dolan describes a fire kindler element formed of papers folded into a compact bundle, but requires added fuel oil. U.S. Pat. No. 1,191,458 to L. R. Philips describes a fire kindler, of newspaper sheets rolled into a tubular shape, with the innermost turn bent into the central longitudinal opening for igniting purposes. U.S. Pat. No. 3,958,499 to P. F. Albee, Jr. describes a roller device for rolling newspapers into essentially a solid log. These prior art techniques have as an objective making fuel elements from paper which have the burning characteristics of wood, but have not been successful.

The process of making paper fuel elements which will burn in a manner similar to wood suffers disadvantage in that paper does not have the fine passages occurring in well-seasoned firewood (generally produced by evaporation of water from sap when the wood is allowed to season by drying, producing in essence, hollow draft tubes or spaces), which provide efficient oxidization of the surface area of the firewood and hence enhance burning. In some locations, seasoned firewood commands a premium price as a result of its ability for efficient burning.

The present invention provides a process and apparatus for producing an improved substitute for firewood which is made from readily available waste materials such as discarded newspapers. The newspapers are formed into individual fuel elements which are useful as fire starters or kindling, and several individual fuel elements may be combined by means of a simple fixture readily usable by most persons, to form a larger fuel element resembling a piece of firewood. The resulting fuel element includes a plurality of air passageways which aid in efficiently supplying air to the interior and exterior paper surfaces, to approach the effect of burning of well-seasoned firewood.

The present method and apparatus for making the fuel elements are simple and readily permit any person to manufacture the improved fuel elements in his home or as needed for later use. These fuel elements have a shape and length permitting ready storage for future use.

It is an object of this invention to produce an improved and economical fuel element from newsprint material (such as discarded newspaper) suitable for efficient burning, the fuel element being useful as kindling sticks or logs for heating and cooking purposes.

It is a more specific object of this invention to provide a way to produce such fuel elements with a minimum of effort and equipment, to duplicate essentially the appearance and performance of seasoned firewood when burning.

It is yet another object of this invention to provide a simple and inexpensive fixture for preparing the improved fuel element from newspaper sheets.

These and other objects are accomplished by the method, apparatus and product in accordance with the invention.

SUMMARY OF THE INVENTION

A newspaper section or set of sheets is manipulated in accordance with the invention to provide an improved fuel element having an enhanced surface area exposed to air which will result in greatly improved combustion of the newspaper. According to the invention, a conventional newspaper section or its equivalent, is folded so that one edge is parallel to but spaced from the opposite edge. The folded newspaper is then rolled to form a cylindrical fuel element. The cylindrical fuel element may be tied or bound to prevent unrolling, and form a kindling piece or a log. Bundles of kindling elements may be formed to serve similarly to firewood. The resulting fuel element may then be stored for burning in a home fireplace, stove or other heating facility.

The method of the invention is advantageously carried out with the use of a fixture in accordance with the invention which holds the rolled fuel element or elements in their generally cylindrical form so they can be individually bound, or bound together in a group to form a larger unit. The fixture includes first and second end supports forming a longitudinal channel. A connecting member may be used to maintain the end supports generally parallel to each other. A constricting member is supported in the channel to reduce the width of the channel locally. A fuel element received in the channel is maintained in its folded and/or rolled condition by the crimping effect of the constricting member. A number of such elements may be made successively and placed in the fixture, which prevents each from unrolling. When a sufficient number are held, they may then be bound in a final bundle configuration which forms a larger fuel element resembling a piece of firewood in size and configuration. This larger element may be removed from the fixture for immediate use of stored for future burning.

DESCRIPTION OF THE INVENTION

Figure 1:
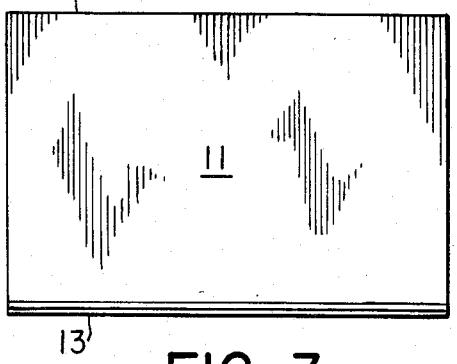
FIG. 1 illustrates a plan view of a set of newspaper sheets which are to be formed into a fuel element.
Figure 2:
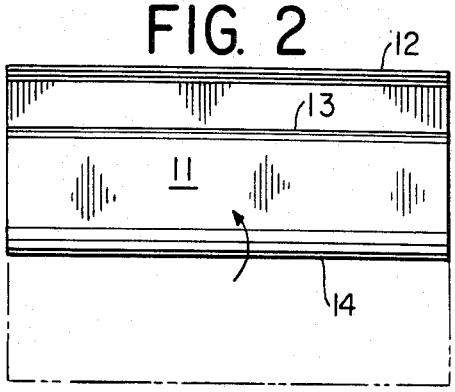
FIG. 2 illustrates a plan view of the sheets after the first (folding) step of the process of forming the fuel element.
Figure 3:
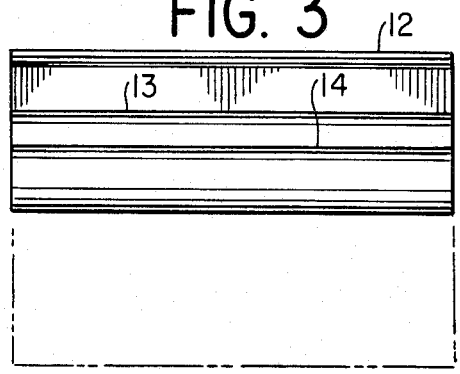
FIG. 3 illustrates a plan view demonstrating the second (rolling) step of the process of forming the fuel element.
Figure 4:
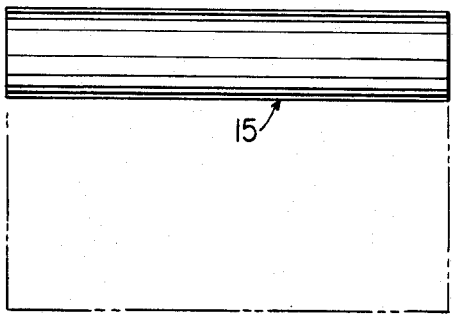
FIG. 4 illustrates a plan view of the final rolled configuration of the fuel element.
Figure 5:
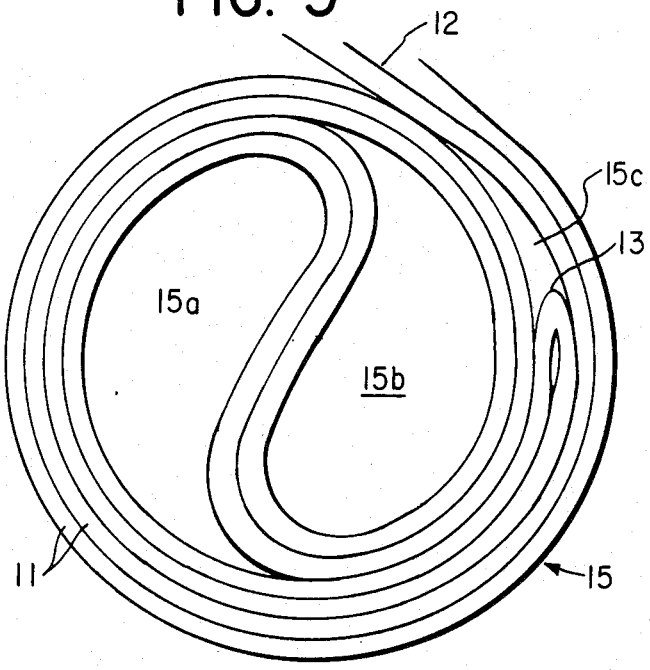
FIG. 5 is an end view of the fuel element of FIG. 4.

FIGS. 1–4 generally show the steps of the process of the invention for producing a fuel element. While this element may be formed from a single newspaper sheet, it is preferred to form it from a plurality of newspaper sheets, which may be in the form of section of a newspaper, containing a set of superposed sheets, folded over together to form a fold edge for the set, and having opposite free edges. In FIG. 1, the generally rectangular newspaper section or set of sheets 11 is shown having an upper free edge 12 and lower fold edge 13. The newspaper section 11 is prepared in accordance with FIG. 2 where the fold edge 13 is itself folded to a position partway to the free edge 12. A suitable arrangement is to a position in from the free edge 12 about two to four inches, or so that the edge 13 is about two-thirds to three-quarters of the distance between the fold 14 and the free upper edge 12. The fold 14 resulting from the step of FIG. 2 is creased, but nevertheless necessarily opens slightly during rolling to leave open space within the fold, as seen below. The folded section 11 is thereafter rolled about the fold 14, as shown in FIG. 3, such that a fuel element 15 is formed, shown in a top view in FIG. 4 and end view in FIG. 5. As shown in FIG. 5, the rolling, while performed tightly, nevertheless inherently leaves longitudinal voids or air channels 15*a*, 15*b*, 15*c*, running the length of the fuel element. In this way the surface area of the newspaper is provided with a maximum exposure to ambient air through these channels 15*a*, 15*b* and 15*c*, thereby providing a combustible fuel element which may be efficiently burned by having a good supply of the air necessary for combustion.

The folding at 14 to space the free edge 12 and fold edge 13 before rolling is an important feature of the invention. It permits including a proper mass of paper for burning, and also serves to create an additional air passage 15*c* longitudinally of the fuel element to facilitate combustion. At the same time, it has been found that manual rolling of the cylinder, no matter how tightly, results in the passageways 15*a*, 15*b* which serve as longitudinal flues during burning.

Figure 6:
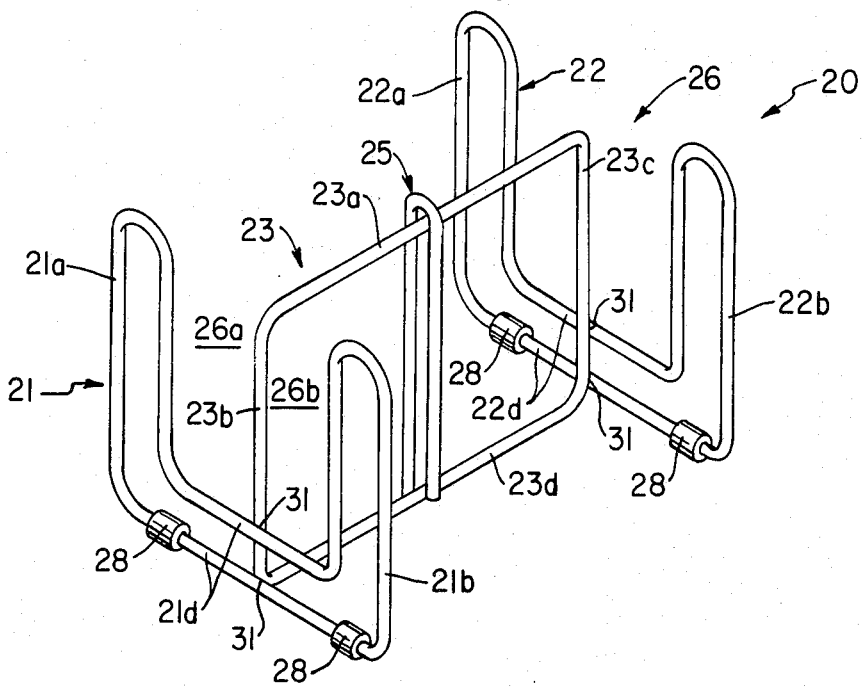
FIG. 6 is an isometric view of a preferred embodiment of a fixture useful in practicing the method of the invention.
Figure 8:
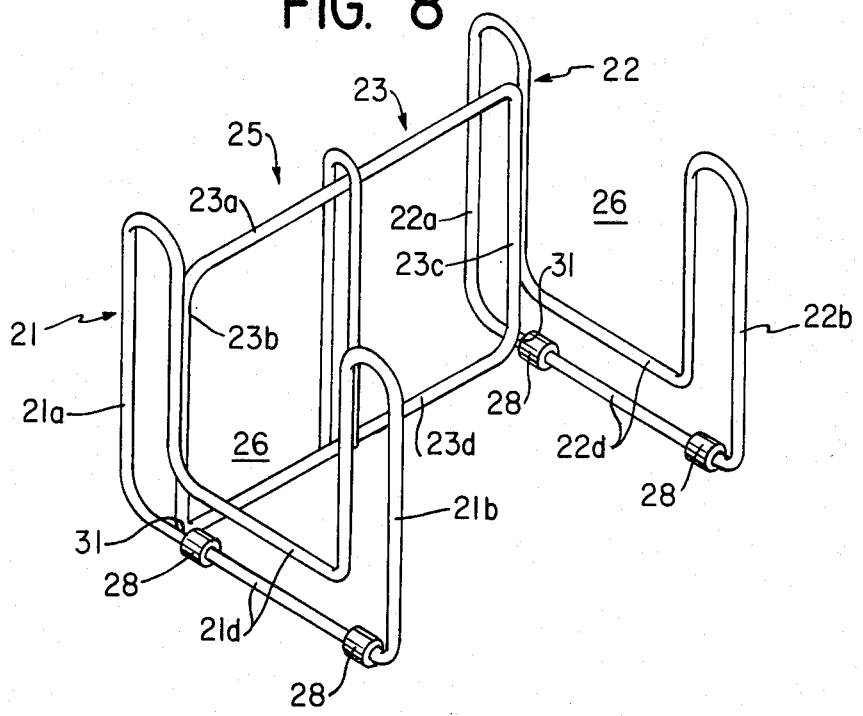
FIG. 8 is an isometric view of another form of fixture useful in practicing the invention.

The rolled fuel element 15 may then be suitably bound to retain its configuration. Smaller diameter fuel elements may be manually tied as they are formed, preferably at the center, and then may serve as kindling pieces. According to one aspect of the invention, one or more of the folded and rolled fuel element 15 may be positioned in appropriate fixtures, as shown in FIGS. 6 and 8, for maintaining them in their folded and rolled condition during tying in a group. Although generally not necessary, individual elements may be tied while in the fixture.

In the form shown in FIG. 6, the fixture 20 is adapted to hold a plurality of smaller diameter fuel elements 15 to facilitate tying them either individually or in a group. As shown in FIG. 6, the fixture 20 has a pair of preferably parallel end pieces 21 and 22, which in this form are made of stiff steel wire rod 21*a* (which illustratively may be about 3/16 inch in diameter) which is appropriately bent to form the end pieces. End piece 22 corresponds in all respects to end piece 21, therefore facilitating manufacture of the device by having only a single configuration for each end piece of the fixture 16.

The wire element 27 is bent to form two upstanding loops 21*a* and 21*b* joined by horizontal sections 21*d*, with all sections in the same plane. The end piece 22 has the same shape as end piece 21. Each end piece 21, 22 supports a pair of rubber, vinyl or other non-skid and non-marring foot members 28, such the device may be utilized on household furniture, without the danger of scratching or marring furniture surfaces.

The end pieces 21 and 22 are maintained in preferably parallel relationship by a connecting element 23 joining the bottom horizontal portions 21*d* of the end pieces, to which it is secured as by welds at 31. The connecting element 23 is preferably in the form of a large plane loop, having parallel horizontal sections 23*a*, 23*d* and vertical sections 23*b*, 23*c*. Element 23 is arranged substantially perpendicularly of the end pieces 21, 22 and extends approximately to the same height as the end piece loops 21*a*, 21*b*, 22*a*, 22*b*, although it may extend above or below that height, as desired. Element 23 effectively partitions the channel 26 into first and second substantially equal subchannels 26*a*, 26*b*, which have a width approximating the desired thickness of the fuel element 15. Illustratively, each subchannel may be about 1 to 2 inches wide, to accommodate small fuel elements of about such size.

Figure 7:
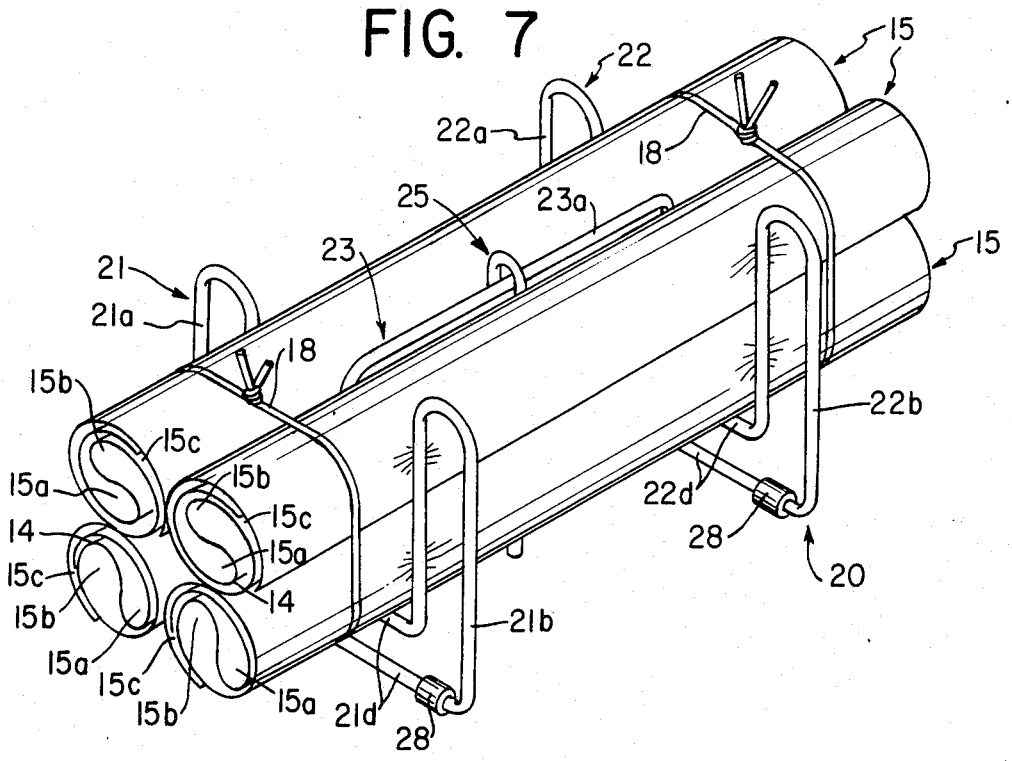
FIG. 7 is an isometric view demonstrating the process of holding folded and rolled fuel elements using the fixture of FIG. 6 preparatory to binding.

About at the midpoint of connecting element 23 and secured to it as by welding is a constriction member 25, extending along both sides of the connecting element 23 and above it. Member 25 places a constriction in each of the subchannels 26*a*, 26*b*. Thus, when a fuel element is placed in a subchannel 26 or 26*b* on either side of the connecting element 23, as shown in FIG. 7, member 25 applies a crimp to the fuel element, preventing the fuel element from unrolling or unfolding.

Once a rolled fuel element 15 is placed in the fixture 16, in one of the subchannels 26*a* or 26*b*, according to one aspect of the invention, it may be tied in rolled configuration by a suitable tie 18, preferably placed around an end of fuel element 15 which projects beyond the fixture 16. The tie 18 may be of wire or any suitable non-combustible material such that the fuel element 15 is maintained in its rolled folded condition during all stages of burning. Alternatively, the fuel element may be left untied for grouping in bundles.

For a larger fuel element, a number of rolled elements 15, such as 2 or 3 or 4, may be placed in the fixture 16, and tied together in a bundle, preferably at each end. The entire bundle may then be removed readily from the fixture 16 by pulling or sliding the bundle upward relative to the fixture.

An important advantage of this aspect of the invention is that the cylindrical fuel elements 15 are held firmly and conveniently in the fixture without unrolling and without need of preliminary binding, so that the units can be easily and quickly bound into the final bundle configuration.

Such bundling is preferred when a fire most closely resembling that derived from firewood is desired, which is aided not only by the channels 15*a*, 15*b*, 15*c* within each element, but also by the voids between the individual fuel elements.

It will be understood that the speed of burning can be varied simply by using more sheets for slower burning combined with tighter rolling.

Figure 9:
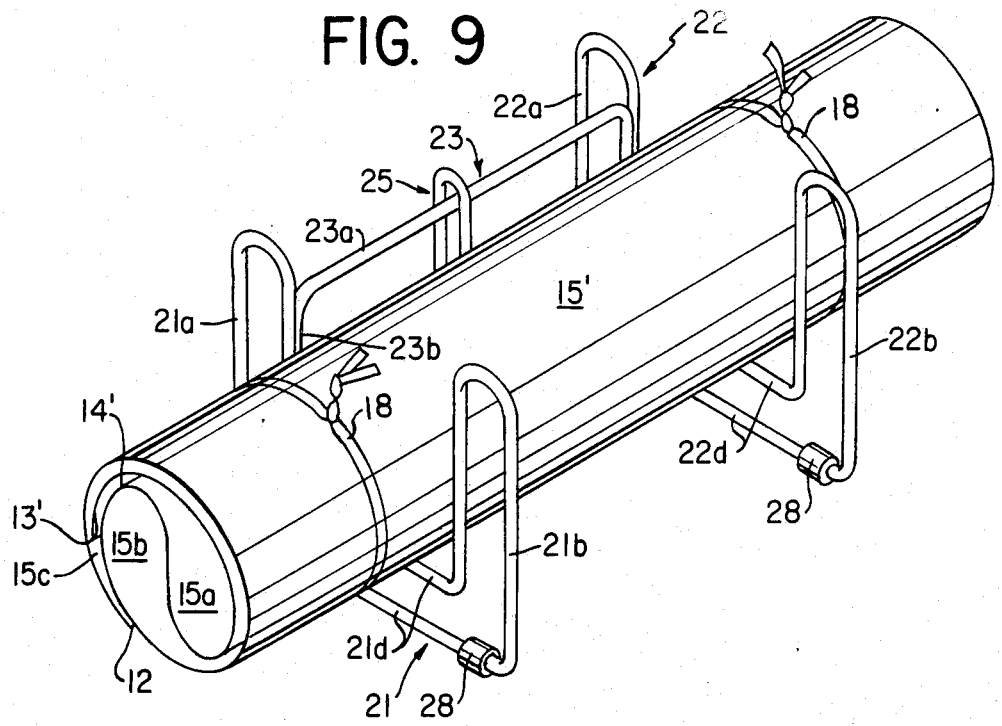
FIG. 9 is an isometric view demonstrating use of the fixture of FIG. 8.

When a larger, slower burning, fuel element is desired, the fixture of FIG. 8 may be used. In this instance, the connecting element 23 for end pieces 21, 22 is offset, to leave an unobstructed main channel 26. The constricting member 25 is placed as before, approximately centrally between end pieces 21, 22, to aid in retaining the fuel element and preventing unrolling. In this instance, the rolled fuel element may include a plurality of newspaper sections, or greater number of sheets, to provide the desired diameter for the fuel element 15. FIG. 9 illustrates the fixture of FIG. 8 with a fuel element in place. As before, a tie 18 is used, outside the fixture, to retain the fuel element against unrolling when removed from the fixture. The tie may be at one end, but is preferably at both ends of the fuel element.

The paper fuel elements 15 thus provide a fully combustible product, readily available to urban as well as suburban and rural fire users. The paper rolled in accordance with the invention provides for enlarged surface area to facilitate the complete and full combustion of the fuel element.

Thus, two embodiments of fixtures have been described which are useful in making fuel elements in accordance with the invention. It will be understood that the wire of the fixture may be plated with brass, nickel or chromium or other materials, or clad in vinyl materials or enameled, or otherwise coated to enhance the aesthetic appeal of the device, as well as to reduce possible corrosion.

Also, while the fixtures are preferably made of wire or rod material (because of ease and economy of manufacture), the fixtures may be made in other forms and of other materials. The end pieces 21, 22 may be flat plates, of metal, plastic or wood, suitably shaped to provide the desired channel or subchannels. The connecting member may also be of plate form, with an appropriate protrusion extending into the channel for constriction of the fuel element, similar in effect to member 25.

In carrying out the invention, when using tabloid-size newspapers, the following steps may be followed. The newspapers may be opened fully and piled to a convenient height. A set about one-eighth inch thick high is picked up, and folded about its original fold. Then this set of papers is folded again, with the original folded edge parallel to and about two or three inches from the free edge. The papers are then fully rolled about the new fold edge to form generally a cylinder, which is placed in the fixture of FIG. 6 as shown in FIG. 7, with a moderate pressure. If the rolled element is materially flattened thereby, too many sheets may have been used; if the rolled element unrolls, too few sheets may have been used. In either case, the number of sheets may be accepted or adjusted.

This procedure may be followed three more times, to place four elements in the FIG. 6 fixture. A tie then is used, about two or three inches from the end of the group of rolled elements, to bind the group into a bundle. Preferably a tie is placed at each end, and the entire bundle is then removed from the fixture.

For even better combustion, two of the four fuel elements are rolled in opposite fashion; that is, the center of two rolls is formed by the cut edges of the sheets, and the outside by the folded edges. For the other two rolls, the center of the rolls is formed by the folded edges and the outside by the cut edges. This combination of open and closed edges produces a log that ignites quickly but burns slowly.

The foregoing procedure may be followed until the pile of sheets is exhausted. Of course, where the newspaper sections already have an appropriate number of sheets or thickness, the initial piling step may be dispensed with.

The invention described above produces a combustible fuel element which will burn efficiently and in a manner similar to seasoned firewood, and provides an ideal and inexpensive fuel for use in fireplaces, kitchen stoves, laundry stoves, campfires, barbeque grills and other heating and cooking apparatus. Individual rolled elements may be used as kindling sticks or as logs. The resulting fuel elements according to the invention serve the same purposes as wood kindling and logs, and are usable in the same manner. They may be stored like wood logs, and arranged in fires in the same manner.

The invention utilizes abundant and readily available material, in the form of discarded newsprint. The prior processing of this material removes much of the extraneous and undesirable content of the original wood material.

This invention provides the combustible material in a form suitable for efficient burning. As in the case of effective wood burning, enlarged surface area exposure is provided, resulting in better combustion and reduced residues, such as tars, ash, soot, gases, etc. The use of newspapers is advantageous because the fibrous nature of the paper provides large surface area for combustion, and the removal of undesirable substances during the paper-making process results in an end product which is more completely combustible and leaves less residue than the wood from which the paper was made. The fuel elements of the present invention will burn down to a bed of coals similar to a wood fire. They have about the same weight as charcoal, and are suitable for convenient use as at picnics, since they are readily ignitable merely by use of a match and no starter is needed.

The fuel elements produced according to the present invention are clean—no chemicals or liquids are added, they are easy to handle, convenient to store (without splinters) and produced with much less effort than needed for sawing and splitting firewood.

While preferred embodiments of the invention have been described, it will be understood that variations may be readily devised without departing from the spirit of the invention, which is defined solely by the appended claims.

What is claimed is:

1. A method for preparing a fuel element from a newspaper section formed of one or more newspaper sheets or the like, comprising the steps of:

folding said newspaper section with the opposite folded portions flat against and in contact with one another, and only partially overlapping, so that one of the edges of said newspaper section is substantially parallel to the opposite edge with each edge spaced from its opposite edge in a direction substantially parallel to or in the plane of said sheets, so that a portion of the folded section has double thickness and another portion has a single thickness;

rolling said folded newspaper section into substantially a cylindrical form; and tying said rolled section to prevent said bundle from unrolling, whereby a single combustible fuel element results.

2. A method for preparing a fuel element from one or more newspaper sheets or the like comprising the steps of:

folding said newspaper sheets so that one of the edges of said newspaper sheets is spaced from the opposite edge and substantially parallel thereto;

rolling said folded newspaper sheets into substantially a cylindrical form;

tying said rolled sheets to prevent said bundle from unrolling, whereby a single combustible fuel element results; and wherein said one edge is folded to be approximately $\frac{2}{3}$ to $\frac{3}{4}$ the distance to the opposite folded edge.

3. The method of claim 1 wherein said section is rolled with the fold at the center.

4. The method of claim 1 wherein said section is rolled with the fold at the outside.

5. The method of claim 1 further comprising the step before said tying step of placing said cylindrical bundle in a fixture to hold said rolled sheets against unrolling.

6. A method for producing a fuel element from newspaper sheets or the like comprising the steps of:

folding a first set of said sheets together so that one of the edges of said set of sheets is spaced from the opposite edge and is substantially parallel to the opposite edge with each of said edges spaced from its opposite edge in a direction substantially parallel to or in the plane of said sheets so that a portion of the folded set of sheets has a double thickness and another portion has a single thickness, rolling said folded set of sheets into a substantially cylindrical form, placing said folded and rolled sheets in a fixture to hold them against unrolling, preparing additional similarly folded and rolled sets of sheets, placing said additional folded and rolled sheets in said fixture, and tying all said folded and rolled sheets in a single bundle to form a fuel element.

7. A method as in claim 6 wherein a part of said sets of sheets are rolled about their folds and the remainder are rolled about their free edges.

8. A fuel element produced by the method of claim 1.

9. A fuel element produced by the method of claim 3.

10. A fuel element produced by the method of claim 4.

11. A fuel element comprising a bundle of fuel elements produced by the method of claim 6.

* * * * *